US009752772B2

(12) United States Patent
Song et al.

(10) Patent No.: US 9,752,772 B2
(45) Date of Patent: Sep. 5, 2017

(54) STEAM SPRAYING APPARATUS AND CLOTHING DRYING MACHINE INCLUDING THE SAME

(71) Applicant: LG ELECTRONICS INC., Seoul (KR)

(72) Inventors: Sungho Song, Seoul (KR); Sungmin Ye, Seoul (KR); Hyukjin Ahn, Seoul (KR); Minji Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/016,331

(22) Filed: Sep. 3, 2013

(65) Prior Publication Data

US 2014/0069152 A1 Mar. 13, 2014

(30) Foreign Application Priority Data

Sep. 4, 2012 (KR) ..... 10-2012-0097836

(51) Int. Cl.

| | |
|---|---|
| ***D06F 58/04*** | (2006.01) |
| ***F22B 1/28*** | (2006.01) |
| ***D06F 39/00*** | (2006.01) |
| ***D06F 58/26*** | (2006.01) |
| ***D06F 58/20*** | (2006.01) |

(52) U.S. Cl.

CPC ..... *F22B 1/288* (2013.01); *D06F 39/008* (2013.01); *D06F 58/04* (2013.01); *D06F 58/203* (2013.01); *D06F 58/263* (2013.01); *F22B 1/287* (2013.01)

(58) Field of Classification Search

None

See application file for complete search history.

(56) References Cited

U.S. PATENT DOCUMENTS

| | | | | |
|---|---|---|---|---|
| 4,034,203 | A | 7/1977 | Cooper | |
| 4,207,683 | A | 6/1980 | Horton | |
| 6,561,079 | B1 | 5/2003 | Müller et al. | |
| 2004/0123490 | A1* | 7/2004 | Pancheri et al. | 34/597 |
| 2007/0079534 | A1* | 4/2007 | Lukas et al. | 38/93 |
| 2008/0000098 | A1* | 1/2008 | Choi et al. | 34/114 |
| 2008/0047172 | A1* | 2/2008 | You | 38/77.5 |
| 2009/0120140 | A1 | 5/2009 | Choi et al. | |
| 2012/0005915 | A1* | 1/2012 | Song | D06F 58/203 34/132 |
| 2012/0045365 | A1 | 2/2012 | Lee | |
| 2013/0047346 | A1* | 2/2013 | Im | D06F 39/008 8/137 |

FOREIGN PATENT DOCUMENTS

| | | | |
|---|---|---|---|
| CN | 1944780 | A | 4/2007 |
| CN | 1989290 | A | 6/2007 |

(Continued)

OTHER PUBLICATIONS

Korean Notice of Allowance dated Dec. 17, 2013 issued in Application No. 10-2012-0097836.

(Continued)

*Primary Examiner* — Michael Barr
*Assistant Examiner* — Cristi Tate-Sims
(74) *Attorney, Agent, or Firm* — Ked & Associates, LLP

(57) ABSTRACT

Provided are a steam spraying apparatus and a clothing drying machine including the same. The steam spraying apparatus include a flow passage forming unit, a steam generating heater, and a nozzle. The flow passage forming unit has a flow passage for guiding water introduced through an inlet to an outlet. The steam generating heater applies heat to water flowing along the flow passage. A nozzle sprays steam generated by the heating of the steam generating heater at a certain pressure.

19 Claims, 19 Drawing Sheets

(56) References Cited

FOREIGN PATENT DOCUMENTS

| | | | | |
|---|---|---|---|---|
| CN | 101024916 | A | 8/2007 | |
| CN | 101701416 | A | 5/2010 | |
| DE | 10 2007 007 354 | A1 | 10/2007 | |
| DE | EP 2267209 | A1 * | 12/2010 | ..... D06F 39/008 |
| EP | 1 290 967 | A2 | 3/2003 | |
| EP | 2 267 209 | A1 | 12/2010 | |
| GB | 656241 | A | 8/1951 | |
| JP | 2008-307266 | A | 12/2008 | |
| JP | 2012-005875 | A | 1/2012 | |
| KR | 10-0587331 | B1 | 6/2006 | |
| KR | 10-0921459 | B1 | 10/2009 | |
| KR | 10-0934659 | B1 | 12/2009 | |

OTHER PUBLICATIONS

Chinese Office Action dated Aug. 3, 2015 issued in Application No. 201310397986.6 (with English translation).
European Search Report dated Jul. 8, 2015 issued in Application No. 13182575.4.
Australian Examination Report dated Jan. 27, 2015 issued in Application No. 2013222056.
Russian Office Action dated Feb. 4, 2015 issued in Application No. 2013140736/12 (Full Russian Text with English Translation).

* cited by examiner

STEAM SPRAYING APPARATUS AND CLOTHING DRYING MACHINE INCLUDING THE SAME

CROSS-REFERENCE TO RELATED APPLICATION(S)

This application claims priority under 35 U.S.C. §119 to Korean Application No. 10-2012-0097836 filed on Sep. 4, 2012, whose entire disclosure is hereby incorporated by reference.

BACKGROUND

1. Field

The present application relates to a steam spraying apparatus and a clothing drying machine including the steam spraying apparatus.

2. Background

Generally, a steam spraying apparatus generates steam by applying heat to water and sprays steam. In a typical steam spraying apparatus, water is contained in a certain container, and is heated until steam is generated through the phase change of water. Thereafter, the generated steam is guided to a nozzle through a hose connected to the container, and then is sprayed.

In this type, water is heated until steam is generated while being stored in a container, that is, being still in the container. In this case, the whole of water needs to be heated to a temperature of 100 degrees Celsius or more at which steam is generated, and thus a long time is spent to generate steam. Also, since a place (container) in which steam is generated is connected to a nozzle through a hose, generated steam may be condensed due to a heat loss while passing the hose, and thus condensate water may be sprayed through the nozzle.

Meanwhile, since the spray pressure of the nozzle is completely dependent on the volume expansion induced by the generation of steam in the container, the spray pressure may not reach a desired degree. Particularly, when the typical steam spraying apparatus is applied to washing machines and clothing drying machines with a structure limitation in which the nozzle is inevitably disposed outside the drum because a drum loaded with clothing rotates, steam sprayed from the nozzle cannot reach clothing. Furthermore, even though steam reaches clothing, clothing can be damaged due to high-temperature steam.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

A clothing drying machine is an apparatus that dries clothing by applying hot air or cool air in a certain space holding clothing. The clothing drying machine may include a typical clothing drying machine including a drum rotatably disposed therein and a blower for blowing air into the drum, and a washing & clothing drying machine with a drying function in addition to a washing function for performing washing through water supply.

Figure 1:
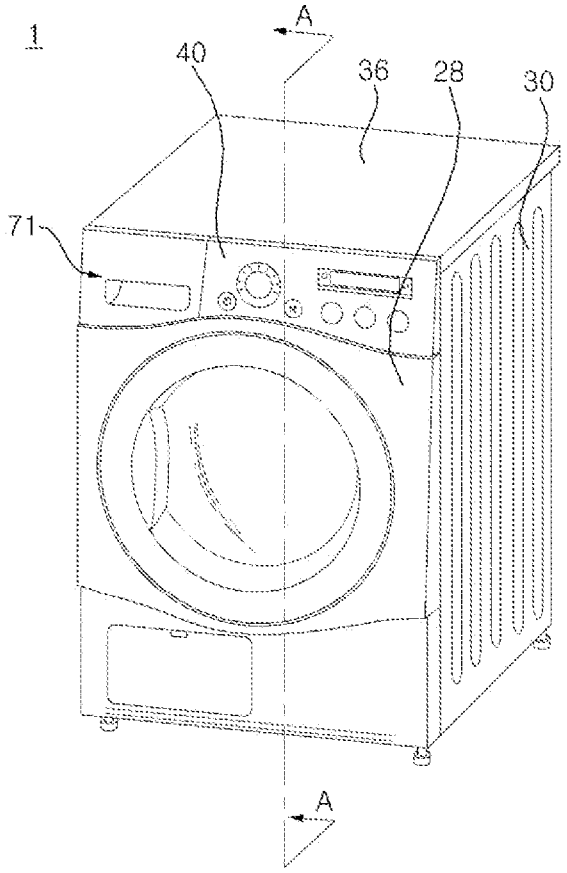
FIG. 1 is a perspective view illustrating a clothing drying machine according to an embodiment of the present application.
Figure 2:
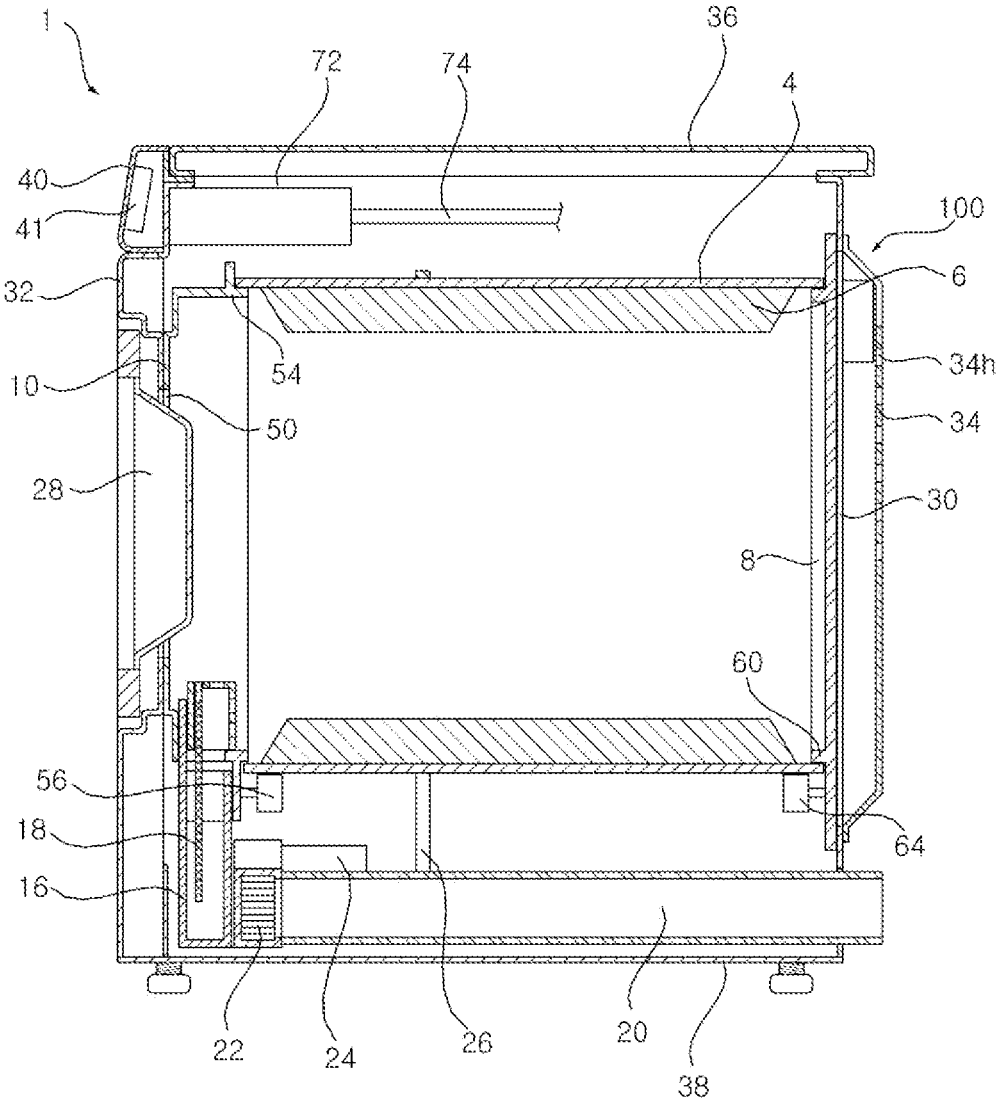
FIG. 2 is a cross-sectional view taken along line A-A of FIG. 1.
Figure 3:
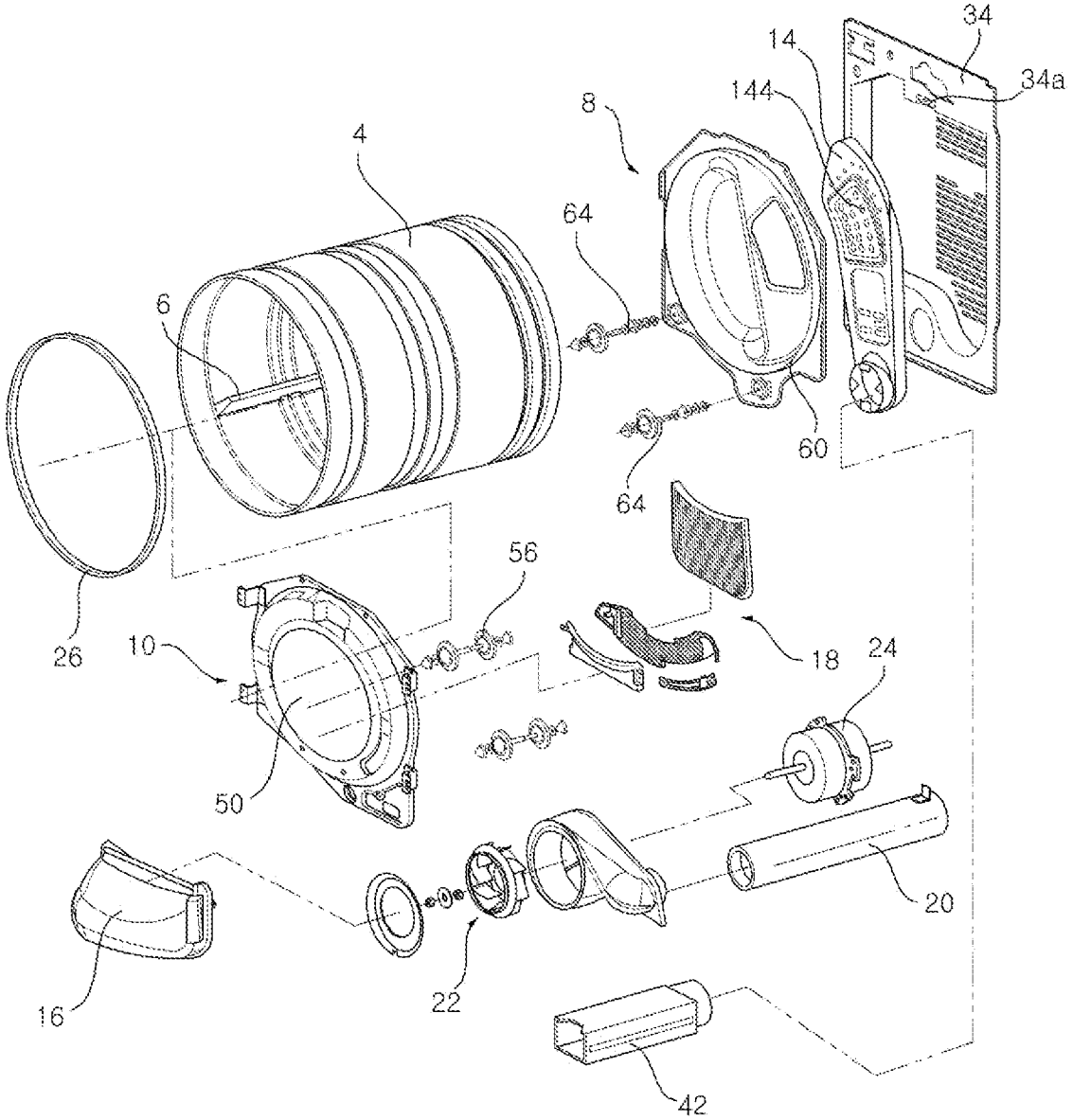
FIG. 3 is an exploded perspective view illustrating a clothing drying machine according to an embodiment of the present application.

FIG. 1 is a perspective view illustrating a clothing drying machine according to an embodiment of the present application. FIG. 2 is a cross-sectional view taken along line A-A of FIG. 1. FIG. 3 is an exploded perspective view illustrating a clothing drying machine according to an embodiment of the present application.

Referring to FIGS. 1 to 3, a clothing drying machine 1 according to an embodiment of the present application may include a casing defining the exterior thereof and a drum 4 rotatably disposed in the casing and receiving clothing. A lifter 6 may be provided on the inner circumferential surface of the drum 4 to tumble clothing according to the rotation of the drum 4.

The casing may include a cabinet 30, a cabinet cover 32, a control panel 40, a back panel 34, a top plate 36, and a base 38. The cabinet cover 32 may be mounted on the front side of the cabinet 30 and may have a clothing loading hole at the center thereof. The control panel 40 may be provided at an upper side of the cabinet cover 32. The back panel 34 may be mounted on the rear side of the cabinet 30 and may have an air hole 34*h* that allows air to flow in and out of the cabinet 30. The top plate 36 may cover the upper portion of the cabinet 30. The base 38 may be mounted under the cabinet 30. A door 28 may be pivotably coupled to the cabinet cover 32 to open or close the clothing loading hole.

The control panel 40 may include an input unit such as buttons or dials, a display unit such as LCD and LED, and a controller 41. The input unit may receive various kinds of control commands related to the operation of the clothing drying machine from a user. The display unit may visually display the operation state of the clothing drying machine. Also, the controller 41 may be disposed on the rear surface of the control panel 40 to control the overall operation of the clothing drying machine.

In an embodiment, the cabinet 30 may include a water receiving unit 72 that supplies water to a steam spraying apparatus 100. For this, a drawer 71 may be withdrawably supported by the cabinet 30, and a water receiving unit 72 may be held in the drawer 71.

A front support 10 and a rear support 8 may be disposed at the front portion and the rear portion in the casing. The front portion and the rear portion of the drum 4 may be supported by the front support 10 and the rear support 8, respectively.

The central portion of the front support 10 may have an opening 50 communicating with the clothing loading hole. Also, a ring-shaped front supporting protrusion 54 may be formed on the rear surface of the front support 10 to support the front end of the drum 4. Also, a front guide roller 56 may be rotatably disposed at a lower portion of the front support 10. The inner circumferential surface of the front end of the drum 4 may be supported by the front supporting protrusion 54, and the outer circumferential surface thereof may be supported by the front guide roller 56.

A ring-shaped rear supporting protrusion 60 may be formed on the front surface of the rear support 8 to support the rear end of the drum 4, and a rear guide roller 64 may be rotatably disposed at the lower portion of the front surface thereof. The inner circumferential surface of the rear end of the drum 4 may be supported by the rear supporting protrusion 60, and the outer circumferential surface thereof may be supported by the rear guide roller 64.

A drying heater 42 may be disposed under the drum 4. A drying duct 14 communicating between the rear support 8 and the drying heater 42 may be disposed such that air heated by the drying heater 42 can be supplied into the drum 4. A lint duct 16 may be disposed on the front support 10 such that air passing the drum 4 can flow therein.

The drying duct 14 may have a plurality of passage holes 144 such that air can be discharged into the drum 4. Due to a blowing force according to the operation of a blower 22, air may flow along the lint duct 16, the blower 22, and a discharge duct 20. Particularly, during the air flowing, air heated by the drying heater 42 may flow along the drying duct 14, and then may be discharged into the drum 4 through the passage hole 144.

Also, air introduced into the lint duct 16 may be purified by a filter 18. The discharge duct 20 may be disposed at the rear surface of the casing such that air inside the line duct 16 can be guided to the outside of the casing.

The blower 22 may be disposed between the discharge duct 20 and the lint duct 16. Also, a motor 24 may be provided to generate a driving force of the blower 22 and the drum 4, and a power transmission belt 26 may be provided to rotate the drum through the driving force of the motor 24.

Figure 4:
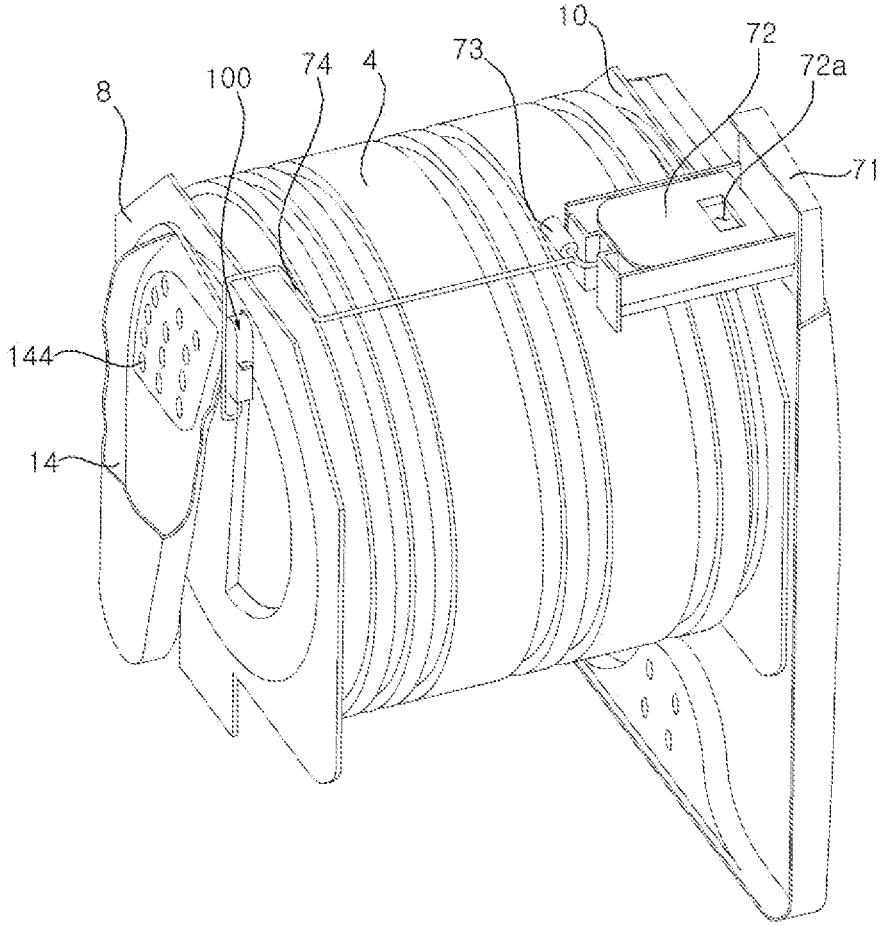
FIG. 4 is a perspective view illustrating the inside of a clothing drying machine including a steam spraying apparatus.
Figure 5A:
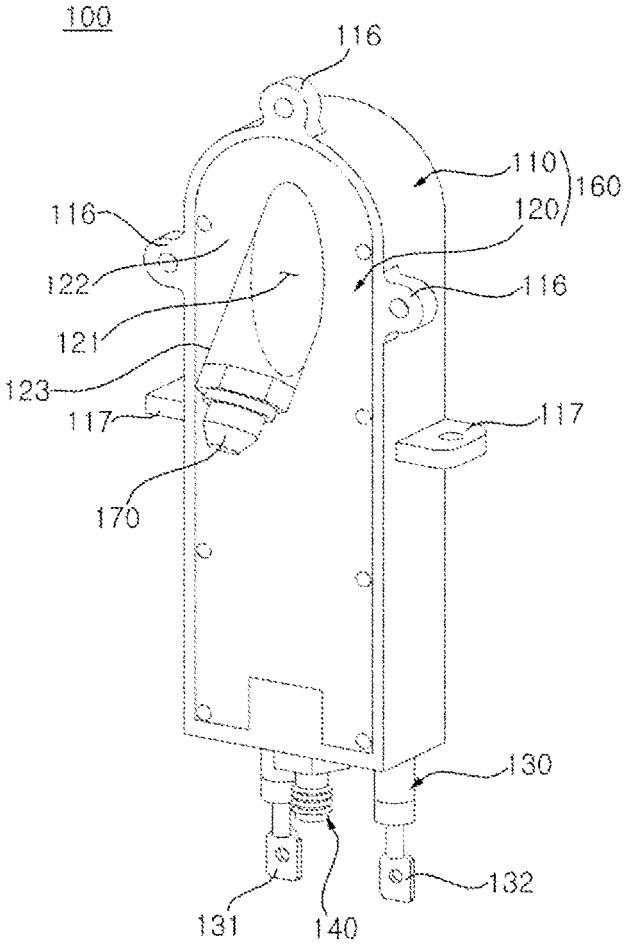
FIG. 5A is a perspective view of a steam spraying apparatus.
Figure 5B:
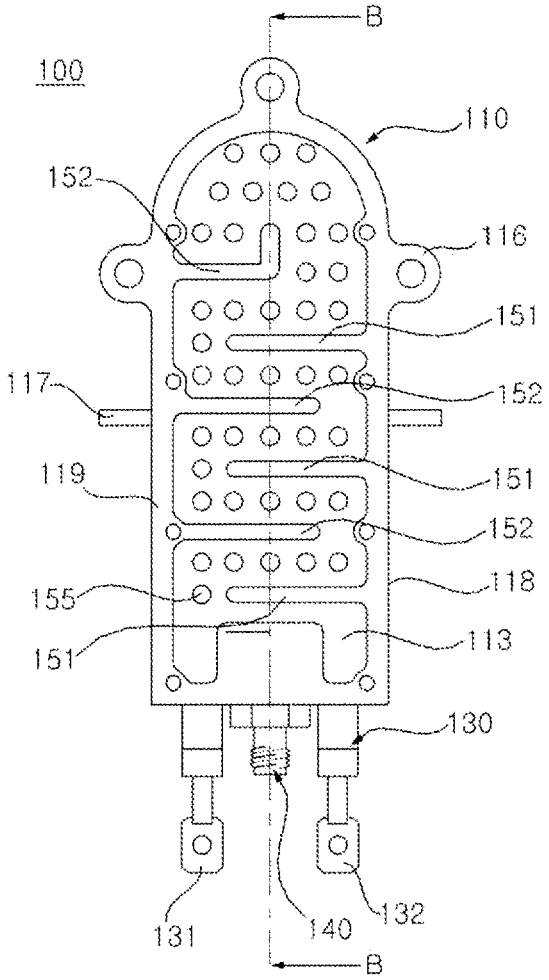
FIG. 5B is a view illustrating a flow passage forming part of a steam spray apparatus.
Figure 5C:
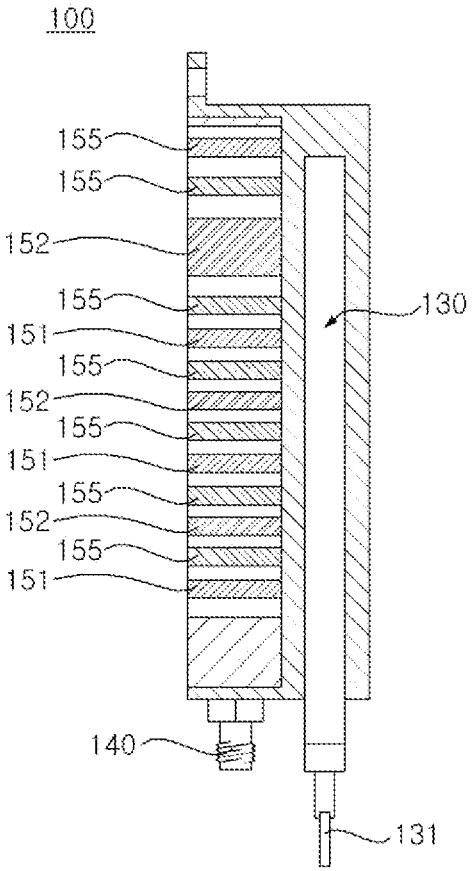
FIG. 5C is a cross-sectional view taken along line B-B of FIG. 5B.

FIG. 4 is a perspective view illustrating the inside of a clothing drying machine including a steam spraying apparatus 100. FIG. 5A is a perspective view of a steam spraying apparatus. FIG. 5B is a view illustrating a flow passage forming part of a steam spray apparatus. FIG. 5C is a cross-sectional view taken along line B-B of FIG. 5B.

Referring to FIGS. 4 and 5, the steam spraying apparatus 100 may spray water into the drum 4. The steam spraying apparatus 100 may include a flow passage forming part 160 and a steam generating heater 130, and a nozzle 170. The flow passage forming part 160 may have a flow passage that guides water introduced through the inlet 140 to an outlet 121. The steam generating heater 130 may apply heat to water flowing along the flow passage in the flow passage forming part 160. The nozzle 170 may spray steam generated by the steam generating heater 130. The nozzle 170 may spray the steam at a certain pressure.

Although it will be described in this embodiment that the water receiving unit 72 is separately provided, the flow passage forming unit 160 may be directly supplied with water from an external water resource such as a faucet. In this case, a water supply hose connected to the external water resource may be connected to the inlet 140, and a valve may be further provided between the inlet 140 and the water supply hose to control water supply. A filter may be further provided to filter foreign substances from supplied water.

In this embodiment, the inlet 140 may be connected to the water receiving unit 72 through a water supply pipe 74, and a pump 73 may be provided to forcibly transfer water from the water receiving unit 72 to the flow passage forming unit 160.

The flow passage forming unit 160 may be integrally coupled to the nozzle 170. Here, the meaning of the integral coupling may include a case where the flow passage forming unit 160 and the nozzle 170 are formed into one member by injection molding as well as a case where the flow passage forming unit 160 and the nozzle are separately formed and then form one unit or module. In either case, the location of the nozzle 170 may be determined by the fixed location of the flow passage forming unit 160.

A typical structure in which water is held and heated in a certain container to generate steam and the steam is transferred to the nozzle through the hose has a limitation in that the steam can be condensed and the condensate water can be sprayed through the nozzle, wetting the drying subject again. However, according to an embodiment of the present application, water may be heated while flowing through the flow passage unit 160, and steam may be sprayed through the nozzle 170 formed integrally with the flow passage forming unit 160. Accordingly, it can be fundamentally prevented that steam is condensed while steam generated in the flow passage forming unit 160 is flowing to the nozzle 170.

The water receiving unit 72 may be disposed in the drawer 71. A user may withdraw the drawer 71, and may supply water through a loading hole 72*a*. Particularly, in case of a clothing drying machine miniaturized in consideration of mobility, it is advantageous to receive water through the water receiving unit 72 rather than receive water from an external water source.

The flow passage forming unit 160 may include a flow passage main body 110 and a cover 120. The flow passage main body 110 may include a flow passage for guiding water from the inlet 140 to the outlet 121, and may have an upper portion opened. The cover may cover the opened upper portion of the flow passage main body 110. According to an embodiment, the flow passage main body 110 and the cover 120 may be integrally formed. The flow passage main body 110 may have the inlet 140 connected to the water supply pipe 74. Water may be introduced into the flow passage main body 110 through the inlet 140.

The steam generating heater 130 may heat water introduced into the flow passage main body 110. Water may be heated to generate steam according to the heating action of the steam generating heater 130. The steam generating heater may be exposed to the flow passage in which water flows, but in this embodiment, will be exemplified as being buried in a bottom 113 of the flow passage main body 110. Since the steam generating heater 130 is not directly exposed to water, there is an advantage in that a separate insulating structure for the insulation of the steam generating heater 130 is unnecessary. The flow passage main body 110 may be formed of a thermal conductive material such as aluminum such that heat transfer from the steam generating heater 130 can be easily performed.

The steam generating heater 130 may include two terminals 131 and 132 for power supply. The terminals 131 and 132 may outwardly protrude from the flow passage main body 110 to be electrically connected to a power supply.

The flow passage main body 110 may form a certain space such that water can be moved to the inside. A plurality of flow passage forming ribs 151 and 152 may be protrusively formed on the bottom of the flow passage main body 110. The flow passage forming ribs 151 and 152 may form a path along which water moves, and may extend from side portions 118 and 119 of the flow passage main body 110.

The plurality of flow passage forming ribs may include a first flow passage forming rib 151 extending from the right side portion 118 of the flow passage main body 110 and a second flow passage forming rib 152 extending from the left side portion 119 of the flow passage main body 110. The first flow passage forming rib 151 and the second flow passage forming rib 152 may be alternately arranged between the inlet 140 and the nozzle 170.

The end portion of the first flow passage forming rib 151 may be spaced from the left side portion 119 by a certain gap, and the second flow passage forming rib 152 may also be spaced from the right side portion 118 by a certain gap. Water supplied through the inlet 140 may be guided along the plurality of flow passage forming ribs 151 and 152. The traveling direction of water may be alternately switched while flowing to the nozzle 170.

The cover 120 may cover the flow passage main body 110, and may be formed integrally with the flow passage main body 110 or may be coupled to the flow passage main body 110 by a coupling member. In this case, airtightness may be maintained between the cover 120 and the flow passage main body 110 such that steam generated in the flow passage main body 110 is not leaked.

The cover 120 may include a plate body 112 covering the flow passage main body 110 and a guide tube 123 extending from the outlet 121 formed in the plate body 112 and guiding steam generated in the flow passage main body 110 to the nozzle 170. The nozzle 170 may be coupled to the end portion of the guide tube 123.

The flow passage main body 110 may include a plurality of coupling parts 116 and 117. The coupling parts 116 and 116 may have a coupling hole to which a coupling member is coupled to fix the flow passage main body 110. The opening direction of each coupling hole may be differently configured in consideration of various installation structures. In this embodiment, the opening directions of the coupling hole formed in the first coupling part 116 and the coupling hole formed in the second coupling part 117 may be different from each other.

A plurality of electric heating protrusions 155 may protrude from the bottom 113 between the first flow passage forming rib 151 and the second flow passage forming rib 152. The plurality of electric heating protrusions 155 may be disposed spaced from each other. Upon heating of the steam generating heater 130, the bottom 113 of the flow passage main body 110 may be heated, and the flow passage forming ribs 151 and 152 and the electric heating protrusions 155 may be together heated. This structure has an effect that can secure a wide heating area by heat transferred from the steam generating heater 130 and thus allow water moving between the flow passage forming ribs 151 and 152 to be quickly phase-shifted into steam. When the flow passage main body 110, particularly, bottom 113 may be formed of a thermal conductive material, the heating effect by the flow passage forming ribs 151 and 152 and the heat transferring protrusions 155 may be improved.

The structure in which the traveling direction of water is alternately switched between the flow passage forming ribs 151 and 152 may apply sufficient heat to water flowing along the flow passage. Furthermore, in consideration of the heat effect by the heat transferring protrusion 155, water may be sufficiently heated before reaching the nozzle 170. Particularly, when comparing with a case where steam is generated by heating water held in a certain place, the embodiment has an effect of significantly reducing time necessary in steam spraying because heat is applied to flowing water and thus the phase change is almost instantaneously achieved.

Also, since water is heated while flowing along the flow passage formed in the flow passage forming unit 160, the pressure may increase as water travels downstream along the traveling direction of the water flow, allowing steam to be sprayed at a high pressure through the nozzle 170. Particularly, in addition to the increasing pressure by the steam at the outlet 121, since the pressure of the water flow is added according to the flow of the water to the outlet 121, the spray pressure of the nozzle 170 may be further strengthened.

During the spraying through the nozzle 170, the temperature at the outlet 121 or the inlet of the nozzle 170 may be maintained at about 70 degrees Celsius (hereinafter, unit of temperature is Celsius), preferably, 70 degrees or less, and the internal temperature of the drum 4 may be maintained at a temperature range from about 30 degrees to about 40 degrees. When the temperature of steam contacting clothing is too high, clothing may be directly damaged, and secondary contamination may occur due to a deformation of spots on clothing. However, in this embodiment, since steam is sprayed at a certain pressure or more through the nozzle 170 and the internal temperature of the drum 4 is maintained about 30 degrees to about 40 degrees, the damage of clothing can be prevented.

Figure 7:
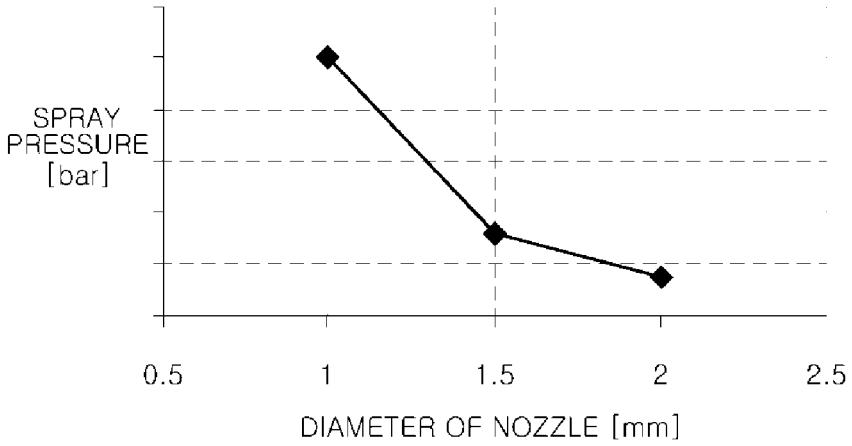
FIG. 7 is a graph illustrating a spray pressure according to a spray diameter of a nozzle.

The spray pressure of the nozzle may be closely related with the diameter of the spray hole. Referring to FIG. 7, under the same conditions except the diameter of the spray hole of the nozzle 170, when the diameter of the spray hole is greater than about 1.5 mm, water sprayed from the nozzle 170 may not hit clothing with a sufficient strength. On the other hand, when the diameter of the spray hole is smaller than about 1 mm, the amount of spray may be insufficient to treat clothing. Also, as the diameter of the spray hole decreases, the possibility of the clogging of the spray hole may increase due to scale. Accordingly, in consideration of various factors, the diameter of the spray hole of the nozzle 170 may range from about 1.5 mm to about 2 mm. In this case, the nozzle 170 may spray water of about 70 cc to about 120 cc per minute.

Also, since water keeps absorbing heat while flowing along a narrow flow passage defined as a gap between the flow passage forming ribs 151 and 152, when the water flow is divided into upstream and downstream according to the traveling direction from the inlet 140 to the nozzle 170, downstream water may be prone to phase change due to much heat-absorbing time, and upstream water may also rapidly generate steam at a portion contacting the bottom 113, where a high temperature and pressure state is generated due to a water pressure according to the flowing of the water in addition to the steam, and a high pressure may act from upstream to downstream. Accordingly, steam finally sprayed through the nozzle may be maintained at a very high pressure, and can reach clothing in the drum 4.

That is, since the steam spraying apparatus 100 can generate and spray steam in a short time, time spent on the steam spray cycle can be reduced, and the power consumption can also be reduced. Also, steam can be sprayed at a high pressure.

Figure 6:
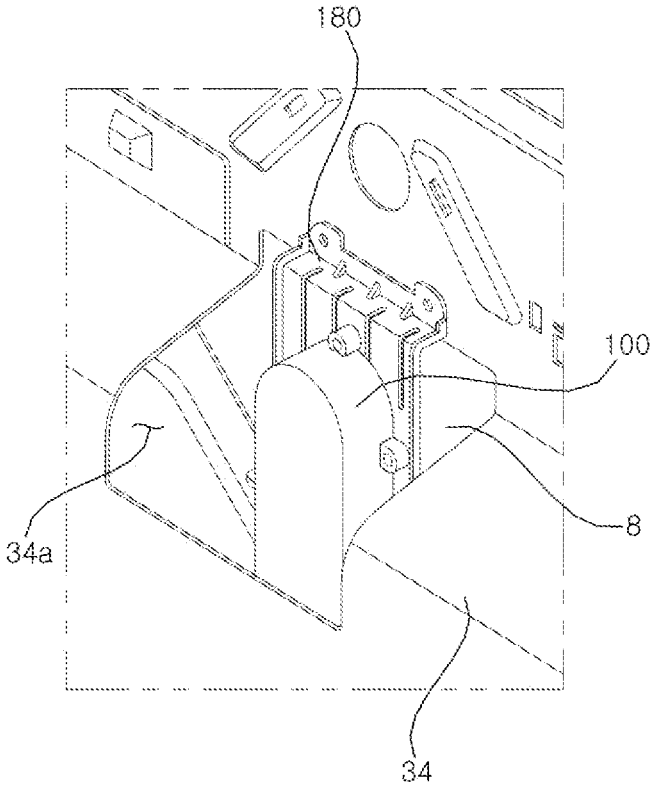
FIG. 6 is a view illustrating a coupling structure of a steam spraying apparatus.

FIG. 6 is a view illustrating a coupling structure of a steam spraying apparatus. Referring to FIG. 6, the rear supporter 8 may have a passage hole (not shown) such that steam sprayed from the nozzle 170 can be sprayed into the drum 4. The nozzle 170 may be inserted into the passage hole.

When considering the structure for fixing the steam generating unit 100, the flow passage main body 110 may be directly coupled to the rear supporter 8, or may be fixedly coupled to the cabinet 30 or the back panel 34. In this case, the flow passage main body 110 is directly coupled to the cabinet 30 or the back panel 34, or may be coupled to the cabinet 30 or the back panel via a separate bracket. In this embodiment, the steam spraying apparatus 100 may be first fixed to the bracket 180, and then the bracket 180 may be coupled to the back panel 34.

The back panel 34 may have an opening 34*a* for convenience of installation and maintenance of the steam spraying apparatus 100, and the bracket 180 may be coupled around the opening 34*a*.

Figure 8:
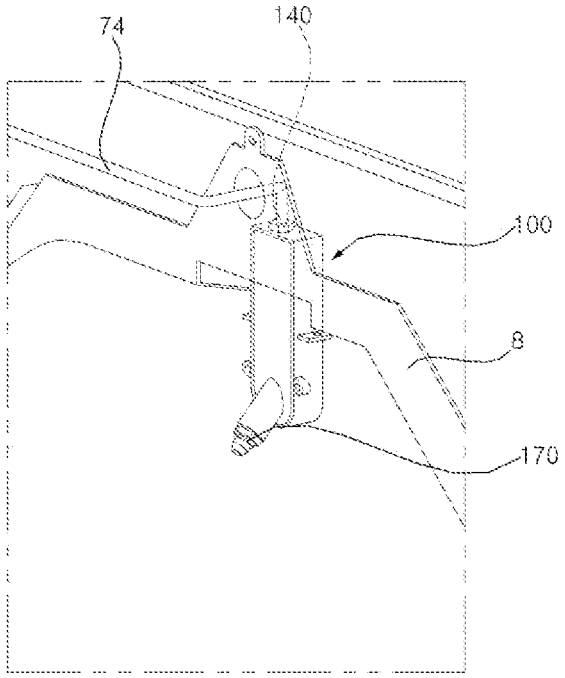
FIG. 8 is a view illustrating an installation structure of a steam spraying apparatus according to another embodiment of the present application.

FIG. 8 is a view illustrating an installation structure of a steam spraying apparatus according to another embodiment of the present application.

Referring to FIG. 8, the flow passage forming unit 160 may be disposed such that the inlet 140 is higher than the nozzle 170. After the pump 73 stops operating, residual water in the flow passage forming unit 160 may be naturally discharged through the nozzle 170. Accordingly, generation of scale and contamination due to residual water in the flow passage forming unit 160 can be prevented. According to an embodiment, the clothing drying machine may perform an operation for cleaning of the flow passage forming unit 160. This cleaning operation may be performed during a cycle provided for the drying function, or may be performed by an separately additional function according to the selection of a user. When this cleaning operation is performed, water may be supplied into the flow passage forming unit 160 to discharge foreign substances such as deposits out of the nozzle 170. The location of the inlet 140 and the nozzle 170 may be determined such that all water supplied through the inlet 140 can be discharged through the nozzle 170 to always maintain the condition that residual water does not exist in the flow passage forming unit 160.

Meanwhile, the amount of steam sprayed from the nozzle 170 and contacting clothing in the drum 4 may be about 40% or more of the total amount of steam generated by heating of the steam generating heater 130. For this, the operation temperature of the steam generating heater 130, the area of the spray hole of the nozzle 170, and the operation pressure of the pump 73 need to be appropriately determined, and particularly, the spray angle of the nozzle 170 may be determined such that steam can be sprayed at an angle of about 30 degrees to about 60 degrees with respect to the horizontal plane.

Steam sprayed through the nozzle 170 needs to contact clothing. Steam sprayed from the nozzle 170 may reach the lowermost portion of the drum 4 such that steam can be applied to clothing regardless of the amount of clothing loaded in the drum 4.

Figure 9:
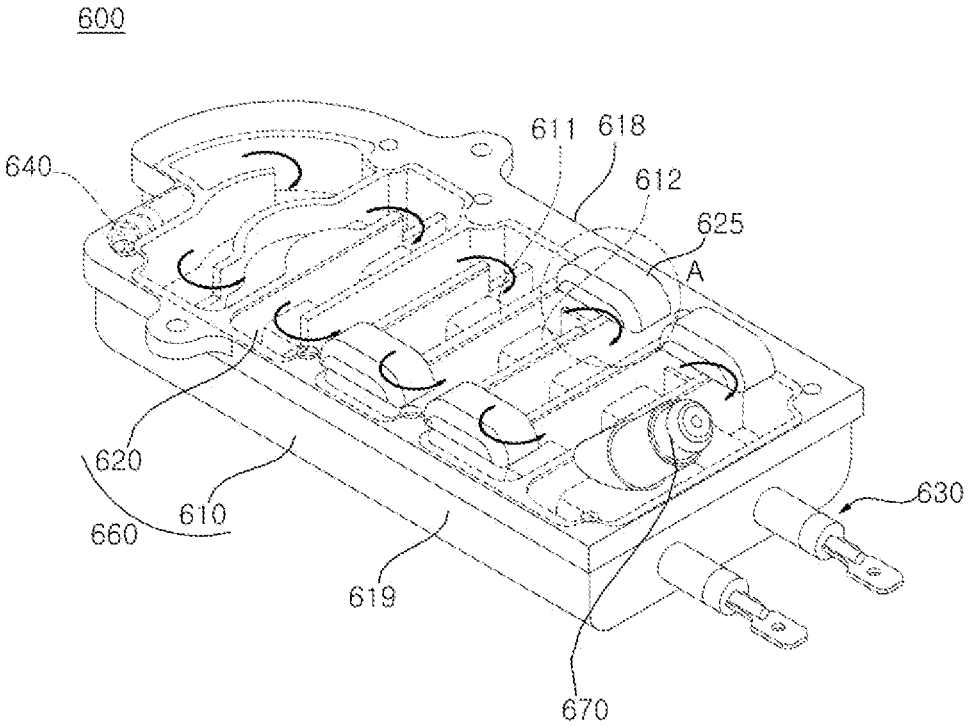
FIG. 9 is a perspective view illustrating a steam spraying apparatus according to still another embodiment of the present application.
Figure 10:
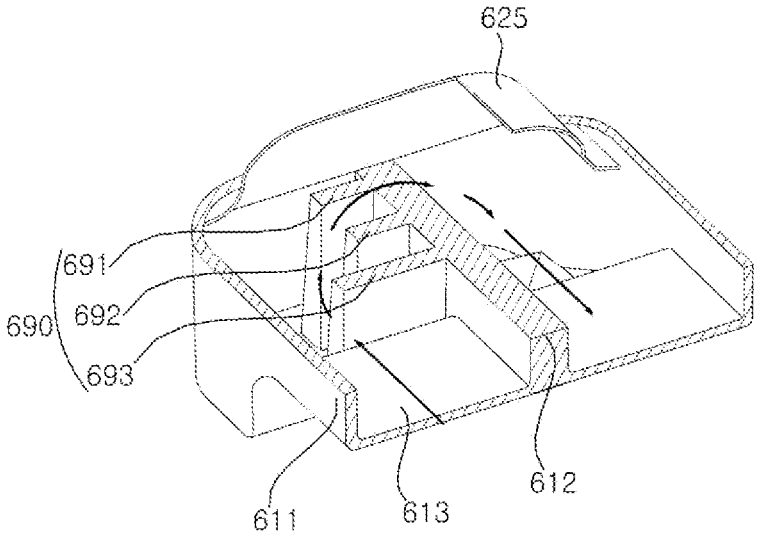
FIG. 10 is a cross-sectional view illustrating a portion A of FIG. 9.

FIG. 9 is a perspective view illustrating a steam spraying apparatus according to still another embodiment of the present application. FIG. 10 is a cross-sectional view illustrating a portion A of FIG. 9.

Referring to FIGS. 9 and 10, a steam spraying apparatus 600 according this embodiment may include a flow passage forming unit 660 and a nozzle 670 like the above-described embodiments. Also, although indicated as different reference numerals, a flow passage main body, a cover 620, a steam generating heater 630, a left side portion 619, and a right side portion 618 will follow the description of the previous embodiments. Accordingly, the description of this embodiment will be focused on differences from the previous embodiments.

In this embodiment, the flow passage forming unit 660 may include a plurality of flow passage forming ribs 611 and 612 protruding from the bottom 613, and may be divided into both spaces based on one of the flow passage forming ribs 611 and 612. Also, the passage forming unit 660 may have a gap for movement of water at an upper side of the flow passage forming rib 612 such that water can overflow the flow passage forming rib 612 while traveling from one of the both spaces pertaining to upstream side to the other space pertaining to downstream side. In order to provide the gap for the movement of water, a gap forming section 625 may be formed in the cover 620. In the gap forming section 625, the inner side surface of the cover 620 may be spaced from the flow passage forming rib 612.

An impactor 690 may be provided in the flow passage forming unit 660, and may extend from the flow passage forming rib 612. The impactor 690 may protrude in plurality toward the space pertaining to the upstream side among the both spaces based on the flow of water.

The impactor 690 may be formed at a location corresponding to the gap forming section 625. Water flowing in the flow passage forming unit may be hit by the impactor 690 at the space pertaining to the upstream side of the both spaces divided by the flow passage forming rib 612, and then may travel to the space pertaining to the downstream side through the gap forming section 625. When this process is continuously repeated, scale may be mainly generated among the impactors 691, 692 and 693. Accordingly, the spray hole of the nozzle 670 can be prevented from clogging.

The impactor 690 may be formed at a plurality of locations, particularly, at sections where the flow direction is switched. The flow passage forming rib may be partially cut such that the water flow can travel even though the gap forming section 625 is not formed at a section where the impactor 690 is not installed among the sections where the flow direction is switched.

Although not shown, the steam spraying apparatus 600 may be configured such that the inlet 640 is disposed over the nozzle 670. Similarly to the embodiment described with reference to FIG. 8, this structure is advantageous to discharging of residual water in the flow passage forming unit 660.

Figure 11:
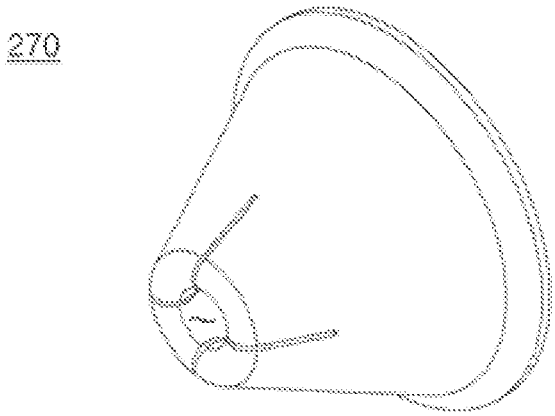
FIG. 11 is a view illustrating a nozzle according to an embodiment of the present application.

FIG. 11 is a view illustrating a nozzle according to an embodiment of the present application. Referring to FIG. 11, a steam spraying apparatus according to an embodiment may include a nozzle varying in the area of the spray hole according to the water pressure. Thus, although the spray hole is narrowed due to scale generated by the continuous use of the steam spraying apparatus, a spray amount of a certain level or more can be secured. This nozzle can be implemented in various types. It will be noted that a nozzle 270 exemplified herein can be applied to any one of the steam spraying apparatus described in the previous embodiments.

The nozzle 270 may be formed of a deformable material. The nozzle 270, particularly, the spray hole may be deformed according to the spray pressure. Although scale is generated around the spray hole, since the area of the spray hole varies, a spray amount of a certain level or more can be secured, and foreign substances in the flow passage forming units 160 and 660 can also be discharged to the outside.

The spray hole of the nozzle 270 may be formed to be cut along the edge thereof multiple times. As the cut portions spread out according to the spray pressure, the diameter of the spray hole of the nozzle 270 may increase.

Figure 12A:
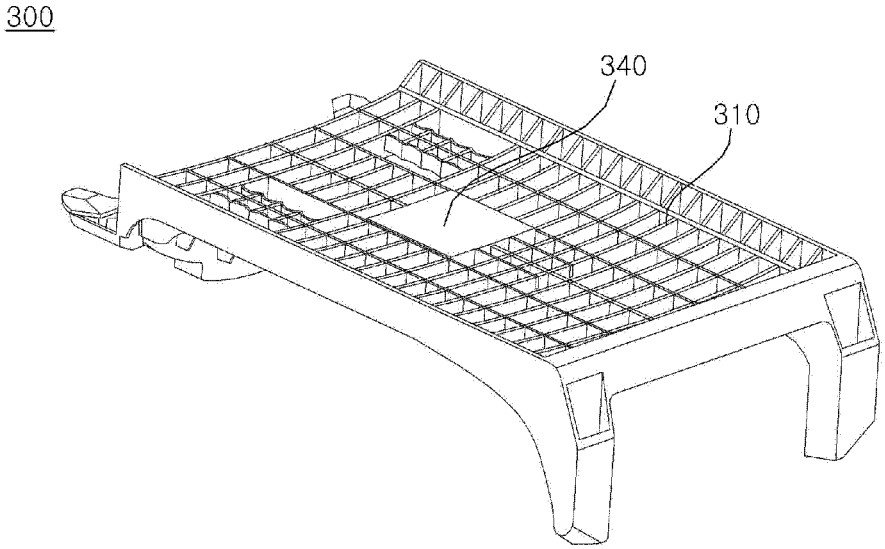
FIGS. 12A and 12B are perspective views illustrating a clothing stand.
Figure 12B:
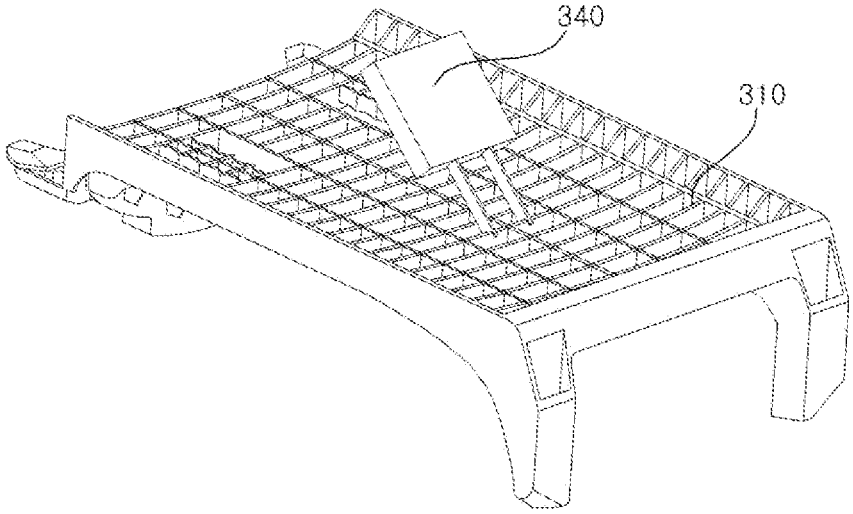

FIGS. 12A and 12B are perspective views illustrating a clothing stand. Referring to FIGS. 12A and 12B, a clothing stand 300 may allow clothing to be placed thereon when clothing is washed through the steam spraying apparatus 100 and 600. Here, the meaning of washing is a process of removing contaminants by applying steam clothing through the steam spraying apparatus 100 and 600 unlike a washing cycle or operation performed by a typical washing machine. Since steam is used, the amount of water required for washing is smaller than that required for typical washing. Accordingly, washing is more efficient, and local contaminants such as spots on clothing can be conveniently removed. Particularly, it is possible to install the steam spraying apparatus 100 and 600 in a typical clothing drying machine to provide a washing function.

The clothing stand 300 may include a base 310 and a support plate 340. The support plate 340 may be pivotably disposed in the base 310, and may adjust the contaminated part of clothing so as to face the spray direction of the nozzle 170. A user may place clothing on the clothing stand such that the contaminated part is located on the support plate 340, and then may adjust the angle of the support plate 340 so as to face the nozzles 170 and 270 such that steam sprayed through the nozzles 170 and 270 accurately reach the contaminated part. The maximum pivotable angle of the support plate 340 may be set corresponding to the spray direction of the nozzles 170 and 270. The clothing stand 300 may be detachably disposed in the drum 4 such that a user can arbitrarily attach or detach the clothing stand 300 only when necessary.

Figure 13:
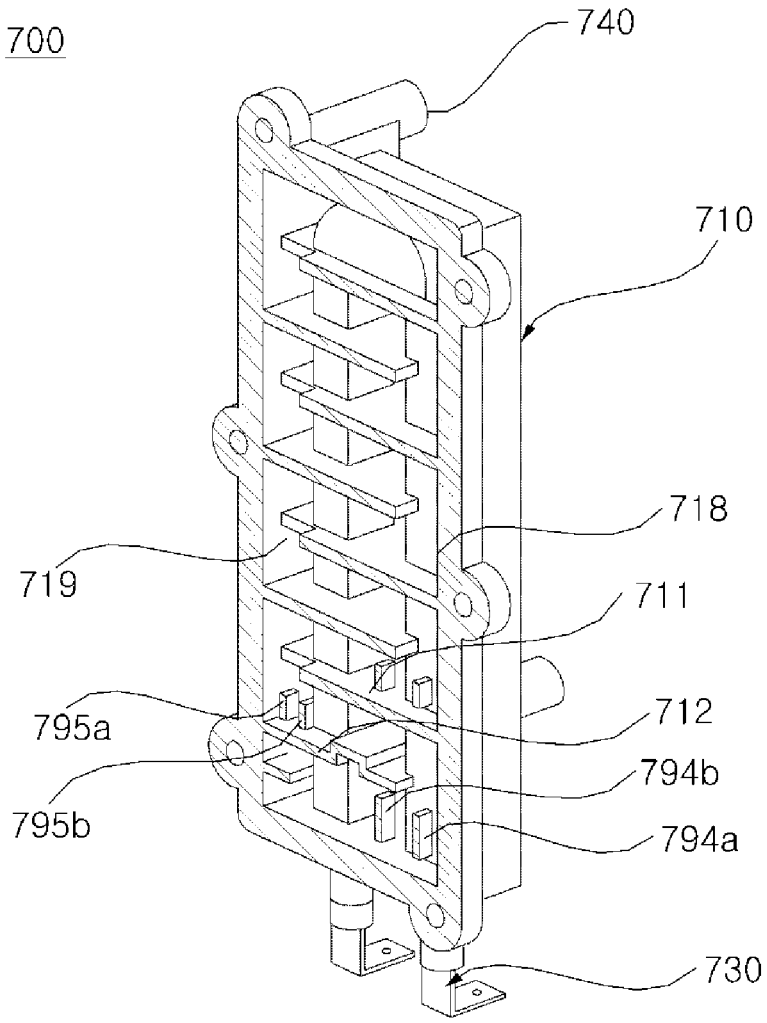
FIG. 13 is a view illustrating a steam spraying apparatus according to still another embodiment of the present application.
Figure 14:
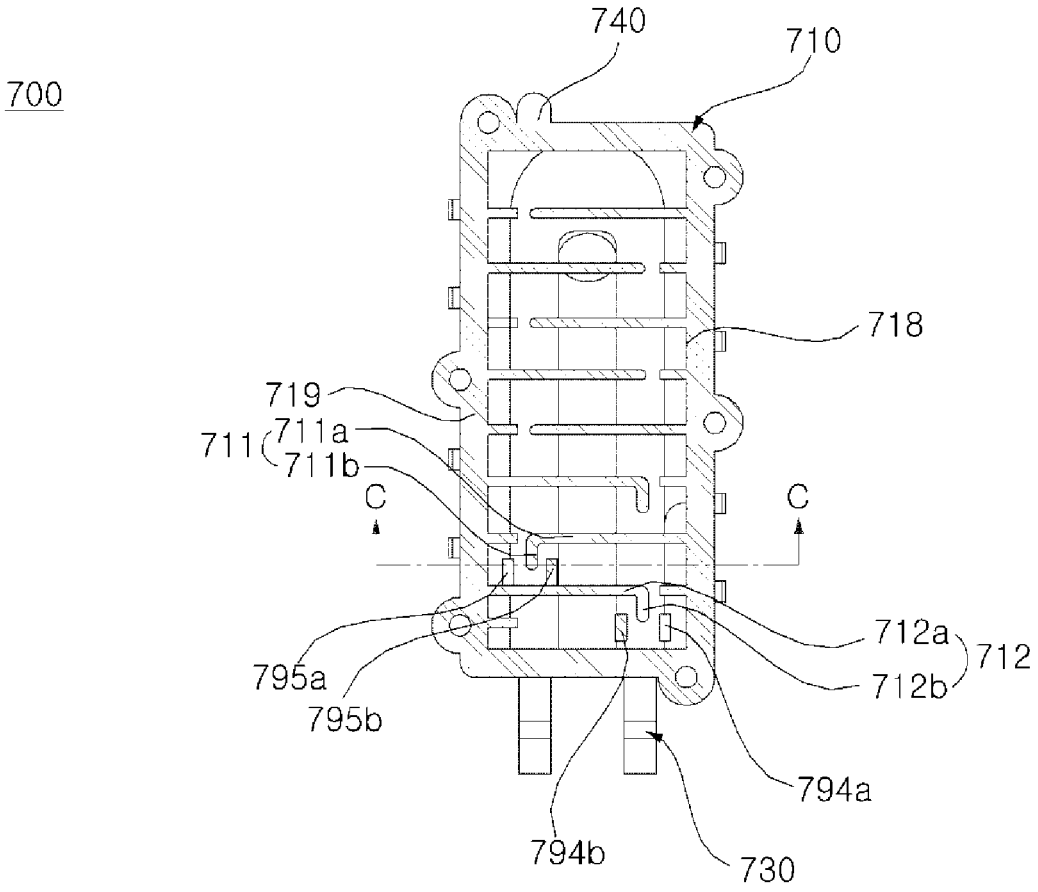
FIG. 14 is a view illustrating the steam spraying apparatus of FIG. 13 when viewed from the front.
Figure 15:
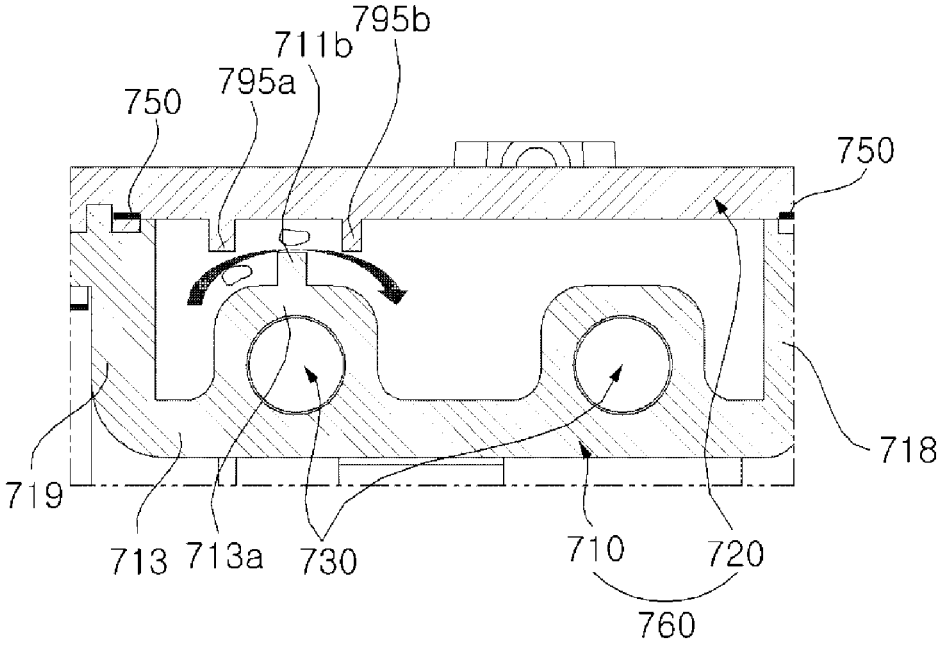
FIG. 15 is a cross-sectional view taken along line C-C of FIG. 14.

FIG. 13 is a view illustrating a steam spraying apparatus according to still another embodiment of the present application. FIG. 14 is a view illustrating the steam spraying apparatus of FIG. 13 when viewed from the front. FIG. 15 is a cross-sectional view taken along line C-C of FIG. 14.

Referring to FIGS. 14 and 15, a steam spraying apparatus 700 according still another embodiment may include a flow passage forming unit 760, a steam generating heater 730, and a nozzle (not shown) like the above-described embodiments. The flow passage forming unit 760 may include a flow passage main body 710 and a cover 720.

Hereinafter, although indicated as different reference numerals, components of the same name as those of the previous embodiment will follow the description of the previous embodiments. Accordingly, the description of this embodiment will be focused on differences from the previous embodiments.

In this embodiment, the flow passage main body 710 may include a plurality of flow passage forming ribs 711 and 712 that are protrusively formed on the bottom 713 of the flow passage main body 710 to form a flow passage.

The flow passage forming ribs 711 and 712 may form a path along which water moves, and may extend from side portions 718 and 719 of the flow passage main body 710. The plurality of flow passage forming ribs may include a first flow passage forming rib 711 extending from the right side portion 718 of the flow passage main body 710 and a second flow passage forming rib 712 extending from the left side portion 719 of the flow passage main body 710.

The end portion of the first flow passage forming rib 711 may be spaced from the left side portion 719 by a certain gap, and the second flow passage forming rib 712 may also be spaced from the right side portion 718 by a certain gap. Water supplied through the inlet 740 may be guided along the plurality of flow passage forming ribs 711 and 712. The traveling direction of water may be alternately switched while flowing.

The first flow passage forming rib 711 may include a horizontal extension part 711*a* extending in a horizontal direction from the right side portion 718 and a vertical extension part 711*b* extending from the end portion of the horizontal extension part 711*a* spaced from the left side portion 719 by a certain gap in a vertical direction, preferably, in a downward direction.

The second flow passage forming rib 712 may include a horizontal extension part 712*a* extending in a horizontal direction from the left side portion 719 and a vertical extension part 712*b* extending from the end portion of the horizontal extension part 712*a* spaced from the right side portion 718 by a certain gap in a vertical direction, preferably, in a downward direction.

Water moving to the left side along the horizontal extension part 711*a* of the first flow passage forming rib 711 may be guided and switched in the flow direction between the horizontal extension part 711*b* and the left side portion 719, and then may move to the right side along the horizontal extension part 712*a* of the second flow passage forming rib 712.

A plurality of collection protrusions 794*a*, 794*b*, 795*a* and 795*b* or impactors may protrude from the 720 to the flow passage main body 710. For reference, FIGS. 13 and 14 show only the collection protrusions 794*a*, 794*b*, 795*a* and 795*b* while omitting other configurations of the cover 720. A more detailed configuration of the cover 720 is shown in the cross-section of FIG. 15.

The collection protrusions 794*a*, 794*b*, 795*a* and 795*b* may be spaced from the bottom 713 of the flow passage forming unit 760 by a certain gap. Due to longtime use of the steam spraying apparatus 700, scale may be deposited in the flow passage forming unit 760. The deposited scale may be broken while fluid (steam or water) flows along the flow passage. The broken scale may float in the fluid. In this case, broken scale having a certain size or more may be collected due to a narrow gap between the collection protrusions 794*a*, 794*b*, 795*a* and 795*b* and the bottom 713. Accordingly, clogging of the nozzle due to scale can be prevented.

The collection protrusions 794*a*, 794*b*, 795*a* and 795*b* may be formed at a section where the flow direction is switched or may be formed adjacent to the section. This is because scale is easy to collect at the section where the flow direction is switched.

Meanwhile, a pair of collection protrusions 795*a* and 795*b* may be disposed across the vertical extension part 711*b*. In this case, since the collection protrusions 795*a* and 795*b* and the vertical extension part 711*b* form a trap or labyrinth structure, the collection of scale can be facilitated.

In the bottom 713, a burying part 713*a* in which the steam generating heater 730 is buried may rise to a space where water flows to secure a broader heat transfer area. In this case, the vertical extension part 711*b* may protrude from the burying part 713*a*. A gap may exist between the vertical extension part 711*b* and the cover 720 such that fluid can pass therethrough.

A sealer 750 may be provided to prevent a leakage of water or steam between the flow passage main body 710 and the cover 720.

Figure 16:
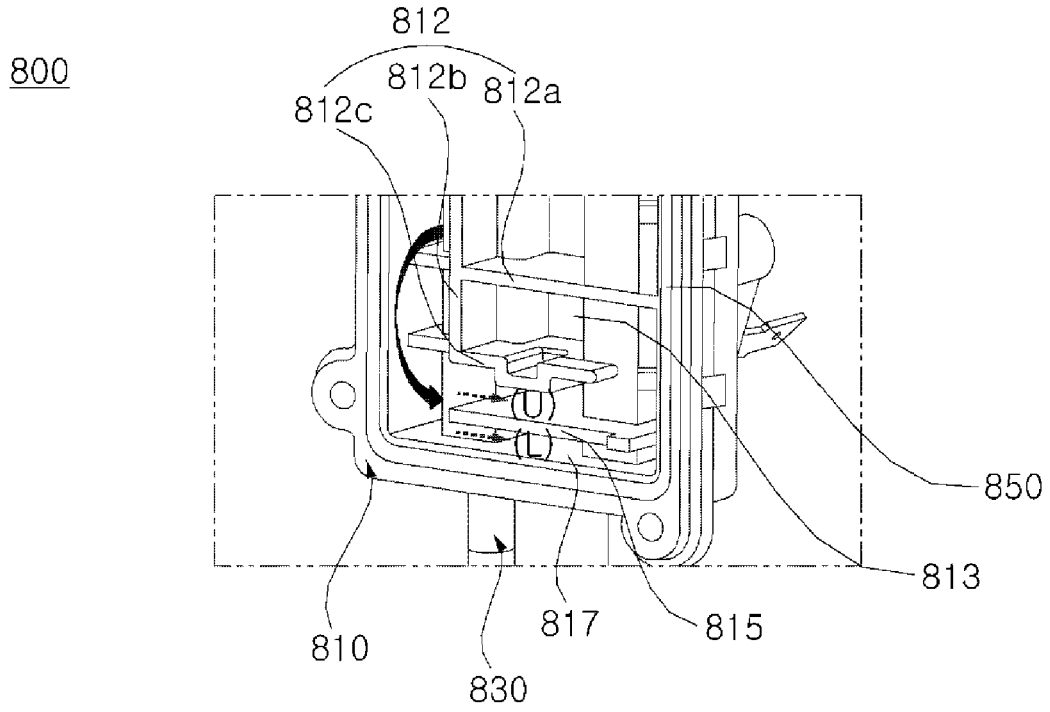
FIG. 16 is a view illustrating a steam spraying apparatus according to still another embodiment of the present application.

FIG. 16 is a view illustrating a steam spraying apparatus according to still another embodiment of the present application. Referring to FIG. 16, a steam spraying apparatus 800 according still another embodiment is different from the previous embodiments in the structure of a flow passage main body 810 but is similar to the previous embodiments in other configurations.

The flow passage main body 810 may include at least one flow passage rib formed at a bottom 813 to switch the flow direction. Similarly to the previous embodiments, the flow passage forming rib may protrude from a right side portion 818 or a left side portion 819 of the flow passage main body 810, respectively (see 711 and 712 of FIGS. 13 to 15). However, as shown in FIG. 16, the flow passage forming rib may include a first horizontal extension part 812*a* extending from the left side portion 819 or the right side portion 818 in a horizontal direction to allow fluid to flow in one direction, a vertical extension part 812*b* extending from the first horizontal extension part 812*a* in a vertical direction, and a second horizontal extension part 812*c* extending from the vertical extension part 812*b* parallelly to the first horizontal extension part 812*a*. Fluid guided to one direction along the first horizontal extension part 812*a* may be guided in a horizontal direction along the vertical extension part 812*b*, and then may be guided in the opposite direction along the second horizontal extension part 812*c*.

The flow passage main body 810 may further include a flow passage branch rib 815 that separates the flow of fluid into an upper stream and a lower stream. Fluid guided along the flow passage formed by the flow passage forming rib 812 may be divided into the upper stream and the lower stream at the flow passage branch rib 815 (see U and L in FIG. 16). Here, the lower stream L may be defined as a flow between the flow passage branch rib 815 and the inner side surface of the flow passage forming unit or a lower side portion 817 of the flow passage main body 810. In an embodiment, the flow passage forming rib may be further provided in the flow passage main body 810. In this case, the lower stream L may be defined as a flow between the flow passage branch rib 815 and the flow passage forming rib.

Since scale floating in the fluid is settled on the bottom due to its own weight, scale may be mainly transferred through the lower stream L among the upper stream U and the lower stream L divided by the flow passage branch rib 815 and deposited. Accordingly, the upper stream U may have a less chance of clogging due to the deposition of scale than the lower stream L. Accordingly, a certain amount of water can flow through the upper passage U, facilitating the generation of steam. The reference numeral 830 undescribed indicates a steam generating heater.

A sealer 850 may be provided to prevent a leakage of water or steam between the flow passage main body 810 and a cover (not shown).

Figure 17:
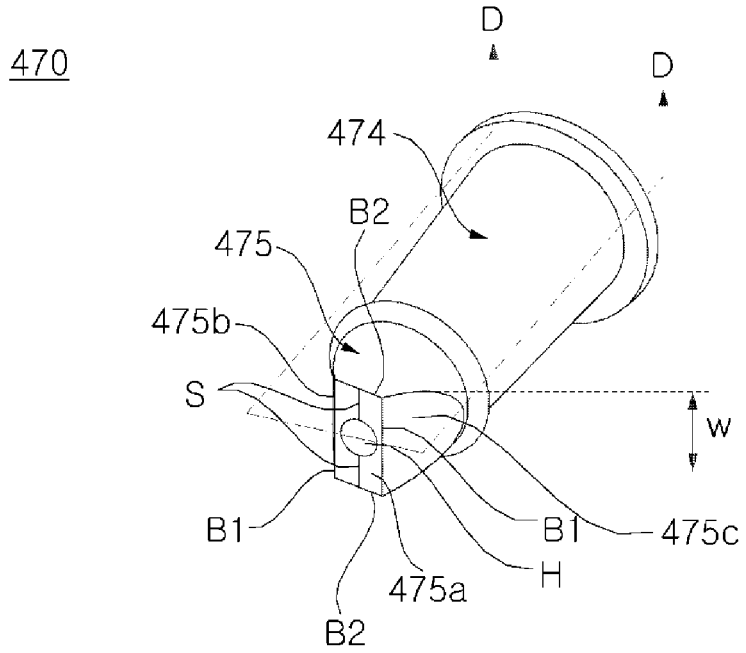
FIG. 17 is a view illustrating a nozzle according to another embodiment of the present application.
Figure 18:
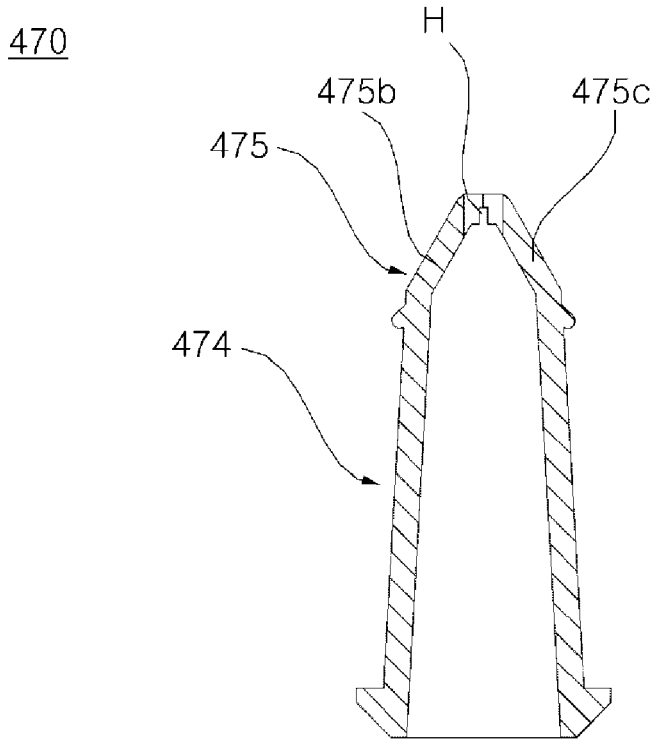
FIG. 18 is a cross-sectional view taken along line D-D of FIG. 17.

FIG. 17 is a view illustrating a nozzle according to another embodiment of the present application. FIG. 18 is a cross-sectional view taken along line D-D of FIG. 17. Referring to FIGS. 17 and 18, a steam generating apparatus according to an embodiment of the present application may include a nozzle 470 that sprays steam generated from a flow passage forming unit into a drum 4. The nozzle 470 may be formed of a deformable material.

The nozzle 470 may include an guide tube 474 for guiding steam from the flow passage forming unit and a nozzle tip 475 that converges steam guided by the guide tube 474 to a spray hole H formed in the nozzle 470.

The nozzle tip 475 may have a spray hole forming surface 475*a* in which the spray hole is formed. The spray hole forming surface 475*a* may have a slit S that is cut across the spray hole H. The spray hole forming surface 475*a* may be defined by long sides B1 extending in a direction corresponding to the slit S and short sides B2 connecting between the long sides B1.

The nozzle tip 475 may have at least one inclination surface 475*b* and 475*c* for converging steam to the spray hole H. The inclination surfaces 475*b* and 475*c* may have a width W in the extending direction of the slit S, and may be inclined toward the long side B1 of the spray hole forming surface 475*a*. The width W of the inclination surfaces 475*b* and 475*c* may become maximum at a connection portion with the long side B1.

Since the nozzle 470 is deformed, particularly, the spray hole forming surface 475*a* is spread around the slit S according to the spray pressure, the shape of the spray hole H may be deformed. Since the area of the spray hole H varies, a spray amount of a certain level or more can be secured, and foreign substances can be smoothly discharged together with steam.

Particularly, deposited scale may mainly have a shape of a thin chip. In this case, since scale is arranged with a directivity parallel to the extending direction of the slit S while being guided by the inclination surfaces 475*b* and 475*c*, scale can be smoothly discharged when the slit S is spread by the spray pressure.

A steam spraying apparatus according to an embodiment of the present application has an effect of spraying a high-pressure steam.

Also, the steam spraying apparatus can prevent condensate water from being discharged through the nozzle.

Also, the steam spraying apparatus can prevent the generation of condensate water before spraying through the nozzle.

Also, a clothing drying machine according to an embodiment of the present application can spray steam into a drum at a high pressure. Accordingly, contaminants on clothing loaded in the drum can be effectively removed.

Also, the clothing drying machine has an effect of reducing time and power necessary to treat clothing using steam. Particularly, since heat is applied to flowing water to instantaneously generate and spray steam, heating and spraying can be almost simultaneously performed. Furthermore, since only a necessary amount of water is heated, power consumption can be reduced.

In addition, the clothing drying machine can prevent damage of clothing.

Furthermore, the clothing drying machine can simply remove stains on clothing.

The present application provides a steam spraying apparatus and a clothing drying machine including the steam spraying apparatus.

The present application also provides a steam spraying apparatus and a clothing drying machine including the steam spraying apparatus.

The present application also provides a steam spraying apparatus and a clothing drying machine including the steam spraying apparatus, which reduces a time taken for steam to be sprayed.

The present application also provides a steam spraying apparatus and a clothing drying machine including the steam spraying apparatus, which can reduce power consumption necessary for steam generation.

The present application also provides a clothing drying machine with a washing function, which can simply remove contaminants on clothing.

According to an aspect of the present application, there is provided a steam spraying apparatus including: a flow passage forming unit including a flow passage for guiding water introduced through an inlet to an outlet; a steam generating heater applying heat to water flowing along the flow passage; and a nozzle spraying steam generated by the heating of the steam generating heater at a certain pressure.

The nozzle may be integrally coupled to the outlet, allowing a location of the nozzle to be determined according to a fixed location of the flow passage forming unit.

The water temperature at the outlet may be about 70 degrees Celsius or less.

The spray rate of the nozzle may range from about 70 cc steam per minute to about 120 cc steam per minute.

The nozzle may include a spray hole, a diameter of which ranges from about 1.5 mm to about 2 mm.

The nozzle may include a spray hole, an area of which varies with the spray pressure. The nozzle may be formed of a deformable material. The nozzle may be cut multiple times along an edge of the spray hole.

The flow passage forming unit may include a plurality of flow passage forming ribs for forming the flow passage, and the plurality of flow passage forming ribs are alternately disposed such that a traveling direction of water is switched multiple times. The steam spraying apparatus may further include a plurality of heat transferring protrusions between the flow passage forming ribs. The steam spraying apparatus may include a bottom heated by the steam generating heater. Here, the flow passage forming ribs and the heat transferring protrusions may protrude from the bottom. The bottom may be formed of a thermal conductive material. Particularly, the bottom may be formed of an aluminum material.

The flow passage forming unit may further include a left side portion and a right side portion extending from a left side and a right side of the bottom, respectively. The flow passage forming ribs may include: a first flow passage forming rib extending from the right side portion and having one end spaced from the left side portion by a certain gap; and a second flow passage forming rib extending from the left side portion and having one end spaced from the right side portion by a certain gap.

The flow passage forming unit may include: a flow passage main body including the flow passage forming ribs protruding from the bottom and having an upper portion opened; and a cover for covering the opened upper portion of the flow passage main body. The cover may include a guide tube for guiding water to the inlet of the nozzle.

The flow passage forming unit may be divided into both spaces based on the flow passage forming rib, and may have a gap for movement of water at an upper side of the flow passage forming rib such that water overflows the flow passage forming rib while traveling from one of the both spaces pertaining to an upstream side to the other space pertaining to a downstream side. The steam spraying apparatus may further include an impactor protruding from the flow passage forming rib to the space pertaining to the upstream side. The impactor may be disposed in plurality along the flow passage.

The steam generating heater may be buried in the flow passage forming unit.

According to an aspect of the present application, there is provided a clothing drying machine including: a casing defining an exterior; a drum rotatably disposed in the casing and receiving clothing; and a steam spraying apparatus generating steam by applying heat to flowing water and spraying the steam into the drum.

The steam spraying apparatus may include: a flow passage forming unit including a flow passage for guiding water introduced through an inlet to an outlet; a steam generating heater applying heat to water flowing along the flow passage; and a nozzle spraying steam generated by the heating of the steam generating heater at a certain pressure. The nozzle may have a spray angle of about 30 degrees to about 60 degrees with respect to a horizontal plane. The steam sprayed through nozzle may reach a lowermost end of the drum.

While water is being sprayed through the nozzle, an internal temperature of the drum may be maintained within a temperature range from about 30 degrees Celsius to about 40 degrees Celsius.

The amount of steam sprayed through the nozzle and reaching clothing may be about 40% or more of a total amount of steam generated by the heating of the steam generating heater.

The nozzle may be integrally coupled to the outlet, allowing a location of the nozzle to be determined according to a fixed location of the flow passage forming unit.

The clothing drying machine may further include a rear supporter for rotatably supporting a rear side of the drum, and the flow passage forming unit is fixed outside the rear support. The casing may include a back panel disposed outside the rear supporter, and the flow passage forming unit is fixed on the back panel. The clothing drying machine may further include a bracket coupled between the back panel and the flow passage forming unit. The inlet of the flow passage forming unit may be disposed at a location higher than the nozzle. When water is supplied through the inlet, the whole of supplied water may be naturally discharged through the nozzle.

The clothing drying machine may further include a clothing stand detachably disposed in the drum and allowing clothing to be placed thereon. Here, the clothing stand may include a support plate pivotably disposed and adjusting a contaminated part of clothing so as to face a spray direction of the nozzle.

According to the steam spraying apparatus and a clothing drying machine including the steam spraying apparatus of the invention, steam can be sprayed at a sufficient pressure.

Further, according to the steam spraying apparatus and a clothing drying machine including the steam spraying apparatus of the invention, condensate water can be prevented from being discharged through a nozzle.

According to the steam spraying apparatus and a clothing drying machine including the steam spraying apparatus of the invention, steam can be sprayed at a sufficient pressure.

The pressure of the injected steam is preferably within a range of 0.2 to 0.4 bars above atmospheric pressure.

Further, according to the steam spraying apparatus and a clothing drying machine including the steam spraying apparatus of the invention, condensate water can be prevented from being discharged through a nozzle.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothing drying machine comprising:

a casing that defines an exterior;

a drum provided in the casing to receive clothing, the drum being rotatable about a substantially horizontal axis;

a rear supporter that rotatably supports a rear side of the drum;

a flow passage forming body including a flow passage that guides water introduced through an inlet to an outlet, the flow passage forming body being fixed to the rear supporter at an outside of the drum;

a steam generating heater that applies heat to water flowing along the flow passage, the steam generating heater applying heat throughout the flow passage; and a nozzle that sprays steam generated by the steam generating heater, wherein the nozzle is fixedly coupled to the outlet to position the nozzle according to a fixed location of the flow passage forming body, wherein the inlet of the flow passage forming body is provided at a higher level than the nozzle so that when water is supplied through the inlet, gravity causes the supplied water to be discharged through the nozzle.

2. The clothing drying machine of claim 1, wherein the nozzle has a spray angle of about 30 degrees to about 60 degrees with respect to a horizontal plane.

3. The clothing drying machine of claim 1, wherein the nozzle is directed towards a lowermost end of the drum.

4. The clothing drying machine of claim 1, further including a drying heater configured such that while water is being sprayed through the nozzle, an internal temperature of the drum is maintained within a temperature range from about 30 degrees Celsius to about 40 degrees Celsius.

5. The clothing drying machine of claim 1, further including a clothing stand detachably provided in the drum to allow clothing to be placed thereon, wherein the clothing stand includes a support plate pivotably provided to adjust a contaminated part of the clothing so as to face a spray direction of the nozzle.

6. The clothing drying machine of claim 1, wherein the flow passage forming body includes:

a flow passage main body including the plurality of flow passage forming ribs and having an upper portion opened; and a cover that covers an opened upper portion of the flow passage main body, the steam spraying apparatus further including at least one collection protrusion that protrudes from the cover toward a bottom of the flow passage main body.

7. The clothing drying machine of claim 6, wherein a gap is provided between the collection protrusion and the bottom.

8. The clothing drying machine of claim 7, wherein the flow passage forming body further includes:

a horizontal extension that extends from one of a left side portion or a right side portion of the flow passage main body to the other; and a vertical extension that extends downward from one end of the horizontal extension, and a pair of collection protrusions is provided across the vertical extension.

9. The clothing drying machine of claim 8, wherein the steam generating heater is embedded in the bottom, and the bottom includes a heater protrusion that protrudes towards an inner side of the flow passage forming body to accommodate the embedded steam generating heater.

10. The clothing drying machine of claim 1, wherein the flow passage forming body further includes a flow passage branch rib that branches fluid guided along the flow passage forming rib into an upper flow passage and a lower flow passage.

11. The clothing drying machine of claim 10, wherein fluid branched into the upper flow passage from the flow passage branch rib is transferred between the flow passage branch rib and the flow passage forming rib.

12. The clothing drying machine of claim 10, wherein fluid branched into the lower flow passage from the flow passage branch rib is transferred between the flow passage branch rib and an inner side surface of the flow passage forming rib.

13. The clothing drying machine of claim 1, wherein:

the nozzle includes a guide tube that guides steam from the flow passage forming body and a nozzle tip that guides steam guided by the guide tube to a spray hole;

the nozzle tip includes a spray hole forming surface in which the spray hole is formed, the spray hole forming surface having a slit that extends in one direction across the spray hole;

the spray hole forming surface is defined by long sides that extend in a direction corresponding to the slit and short sides that connect between the long sides; and the nozzle tip has at least one inclination surface to converge steam to the spray hole, the inclination surface having a width in an extension direction of the slit and inclined toward the long side.

14. The clothing drying machine of claim 13, wherein the nozzle is formed of a deformable material.

15. The clothing drying machine of claim 2, wherein the nozzle includes multiple cut portions arranged along a circumference of the spray hole.

16. The clothing drying machine of claim 1, wherein the nozzle includes a spray hole, a diameter of which ranges from about 1.5 mm to about 2 mm.

17. The clothing drying machine of claim 6, wherein the flow passage forming body further includes a plurality of heat transferring protrusions between the plurality of flow passage forming ribs, wherein the plurality of heat transferring protrusions protrudes from the bottom.

18. The clothing drying machine of claim 1, wherein the flow passage main body further includes a first side wall and a second side wall opposing the first side wall, and the plurality of flow passage forming ribs includes:

a first flow passage forming rib that extends from the first side wall and has one end spaced apart from the second side wall; and a second flow passage forming rib that extends from the second side wall and has one end spaced apart from the first side wall.

19. The clothing drying machine of claim 1, wherein the flow passage forming body includes:

a bottom heated by the steam generating heater; and a plurality of flow passage forming ribs that protrudes from the bottom to form the flow passage on the bottom, wherein the plurality of flow passage forming ribs extends along the bottom and is alternately provided such that a flowing direction of water is switched multiple times, wherein the flow passage forming body is divided into an upstream side and a downstream side by each of the plurality of flow passage forming ribs, and wherein the flow passage forming body further includes:

a gap forming section that provides a gap above the plurality of flow passage forming ribs to allow water to flow over the plurality of flow passage forming ribs while water flows from the upstream side to the downstream side; and a plurality of impactors that protrudes from the plurality of flow passage forming ribs towards the upstream side at a location that corresponds to the gap forming section, wherein the gap forming section is a cutout provided for movement of water at an upper side of each of the plurality of flow passage forming ribs such that water flows over the plurality of flow passage forming ribs while flowing from the upstream side to the downstream side.

* * * * *